United States Patent [19]

Hilgarth

[11] Patent Number: 4,860,961

[45] Date of Patent: Aug. 29, 1989

[54] GARDEN CHIPPER/SHREDDER

[75] Inventor: Günter Hilgarth, Leutershausen-Neuenkirchen, Fed. Rep. of Germany

[73] Assignee: Crones & Co., GmbH, Ansbach, Fed. Rep. of Germany

[21] Appl. No.: 213,638

[22] Filed: Jun. 30, 1988

[30] Foreign Application Priority Data

Jul. 7, 1987 [DE] Fed. Rep. of Germany ..... 3722339

[51] Int. Cl.[4] ..... B02C 18/12

[52] U.S. Cl. ..... 241/92; 241/101.7; 241/152 A; 241/285 B

[58] Field of Search ..... 241/101.7, 92, 285 B, 241/152 A, 152 R; 144/176

[56] References Cited

U.S. PATENT DOCUMENTS 4,595,148 6/1986 Luerken et al. ..... 241/101.7 X
4,778,117 10/1988 Karg ..... 241/101.7 X

FOREIGN PATENT DOCUMENTS 3339312 5/1985 Fed. Rep. of Germany ... 241/101.7
3528507 1/1987 Fed. Rep. of Germany ... 241/101.7

*Primary Examiner*—Mark Rosenbaum
*Attorney, Agent, or Firm*—Herbert Dubno; Andrew M. Wilford

[57] ABSTRACT

A garden chopping/shredding apparatus has a frame provided with an upwardly open intake hopper on the frame having a lower end in which is in turn provided a generally horizontal blade plate and formed about the axis with a plurality of angularly spaced apertures. Respective flat blades carried on the blade plate have cutting edges above the apertures and a plurality of prechopping blades carried on the blade plate projecting upward therefrom have cutting edges inclined upward and inward toward the axis. The drive rotates the plate and the blades in a predetermined direction about the axis so as to define with the cutting edges of the flat blades a generally planar and circular orbit perpendicular to the axis and having an inner periphery offset radially outward from the axis and to define with the cutting edges of the chopping blades an upwardly tapered frustoconical orbit centered on the axis and having a small-diameter upper end and a large-diameter lower end. A deflector or abutment plate fixed against rotation in the lower end of the hopper has a panel with a lower cutting edge juxtaposed with the orbit of the flat blades and an inner edge juxtaposed with the orbit of the prechopping blades. This panel forms an acute angle open backward into the direction of rotation with the orbit of the flat blades and its lower cutting edge extends generally tangentially to a circle centered on the axis and having a greater diameter than the inner periphery of the orbit of the flat blades.

12 Claims, 4 Drawing Sheets

GARDEN CHIPPER/SHREDDER

FIELD OF THE INVENTION

The present invention relates to a garden-type chipper/shredder. More particularly this invention concerns such an apparatus used to comminute branches, twigs, and leaves for disposal or use as mulch.

BACKGROUND OF THE INVENTION

A standard garden chopping/shredding apparatus has a frame carrying an upwardly open intake hopper having a lower end in which is a generally horizontal blade plate rotatable about an upright axis and formed about the axis with a plurality of angularly spaced apertures. Respective flat blades carried on the blade plate have cutting edges above the apertures and a plurality of prechopping blades are carried on the blade plate and project upward and outward therefrom. A drive can rotate the plate and he blades in a predetermined direction about the axis to define with the cutting edges of the flat blades a generally planar and circular orbit perpendicular to the axis and having an inner periphery offset radially outward from the axis and to define with the cutting edges of the chopping blades an orbit shaped as a body of revolution. A deflector or abutment plate fixed against rotation in the lower end of the hopper has a panel with a lower cutting edge juxtaposed with the orbit of the flat blades and another edge juxtaposed with the orbit of the prechopping blades.

As described in German Patent document 2,934,792 the prechopping blades are oriented in a V and the abutment plate is triangular and substantially vertical, that is parallel to the blade rotation axis. The lower side of the abutment plate acts as a counteredge for the flat blades and its outwardly inclined edges work with the inner edges of the prechopping blades. Branches of any size are fed into the device through a lateral feed tube that bypasses the abutment plate and that opens at its inner end directly above the flat blades and adjacent the prechopping blades.

Thus with this known device it is necessary to sort the material being chopped, feeding small twigs, leaves, and the like into the hopper and inserting the lager branches into the separate large-material tube. In addition this arrangement must rotate its blades at very high speed, often several thousand revolutions per minute, so that the machine makes a high-pitched and very annoying noise. Finally the known machines jam rather easily, require that the material be pushed into them, and their blades wear out rapidly.

OBJECTS OF THE INVENTION

It is therefore an object of the present invention to provide an improved garden-type chopping/shredding apparatus.

Another object is the provision of such a garden-type chopping/shredding apparatus which overcomes the above-given disadvantages, that is which operates quietly, which does not require that the material being chopped be presorted, and that has a long service life.

A further object is to provide such a device which automatically pulls the material in by itself, and which is not prone to jamming up.

SUMMARY OF THE INVENTION

A garden chopping/shredding apparatus according to the invention has a frame provided with an upwardly open intake hopper on the frame having a lower end in which is in turn provided a generally horizontal blade plate rotatable about an upright axis and formed about the axis with a plurality of angularly spaced apertures. Respective flat blades carried on the blade plate have cutting edges above the apertures and a plurality of prechopping blades carried on the blade plate projecting upward therefrom have cutting edges inclined upward and inward toward the axis. The drive rotates the plate and the blades in a predetermined direction about the axis so as to define with the cutting edges of the flat blades a generally planar and circular orbit perpendicular to the axis and having an inner periphery offset radially outward from the axis and to define with the cutting edges of the chopping blades an upwardly tapered frustoconical orbit centered on the axis and having a small-diameter upper end and a large-diameter lower end. A deflector or abutment plate fixed against rotation in the lower end of the hopper has a panel with a lower cutting edge juxtaposed with the orbit of the flat blades and an inner edge juxtaposed with the orbit of the prechopping blades. This plate forms an acute angle open backward into the direction of rotation with the orbit of the flat blades and its lower cutting edge extends generally tangentially to a circle centered on the axis and having a greater diameter than the inner periphery of the orbit of the flat blades.

This system can operate at relatively slow speed, normally less than 300 rev/min. The relative orientations of the blades and abutments cause thicker material to be urged outward where they are subject to slicing action at their ends, while the thinner material is pulled inward where it is prechopped by the prechopping blades. In fact branches up to 50 mm and more in diameter can be loaded in with small twigs, leaves, and the like without jamming the apparatus. Furthermore the material is pulled in by the cutting action, so that once dropped into the hopper the user need not push the material down to ensure that it is effectively chopped and/or shredded.

According to this invention the the deflector plate has an upstream panel defining the lower and inner cutting edges and a downstream panel forming a portal opening over the prechopping blades with the upstream panel and having its own inner and lower cutting edges respectively juxtaposed with the orbits of the prechopping and flat blades also. To further enhance the sorting action the two panels extend at an obtuse angle to each other with the angle open toward the axis and the upstream panel has an upstream portion and a downstream portion. The former forms a smaller angle with the flat-blade orbit than the latter and both form the respective lower cutting edge.

In accordance with a further invention feature the blade plate has a substantially square upper plate carrying the prechopping blades and having diagonally opposite corners at the cutting edges of the prechopping blades. Each prechopping blade extends over about half of a respective side edge of the upper plate and there are two prechopping blades symmetrically oppositely arranged on the upper plate with respect to the axis. Furthermore there are four such flat plates and apertures angularly equispaced about the axis with each flat-plate cutting edge extending generally in line with a respective side edge of the upper plate. The flat blades are inclined back and down from the respective cutting edges.

The drive according to the invention rotates the blades at less than about 300 rev/min. This greatly reduces the pitch and annoyance factor of the noise produced by the machine.

To ease clearing any jams, although such occur only rarely with the invention machine, it is provided with a hinge supporting the hopper on the frame for movement between a use position sitting over the blade plate and a position with its lower end swung back away from the blade plate. This hinge comprises two tabs on the frame and recesses on the base plate receiving the tabs. To solidly anchor the hopper in place the base plate is provided with a plurality of angularly offset centering tabs and the frame is provided with respective seats in which the centering tabs engage in the use position. These tabs are elongated and the seats are complementarily elongated. It is also possible to replace the tabs with downwardly tapered bolts and to complementarily shape the seats.

DESCRIPTION OF THE DRAWING

The above and other objects, features, and advantages will become more apparent from the following, reference being made to the accompanying drawing in which.

SPECIFIC DESCRIPTION

Figure 1:
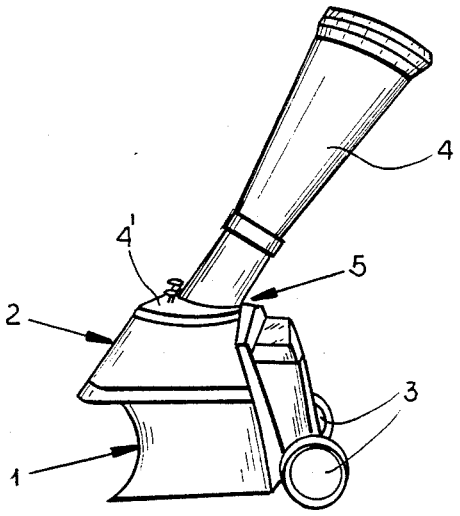
FIGS. 1 and 2 are small-scale perspective side and end views of the chipper/shredder according to this invention.
Figure 2:
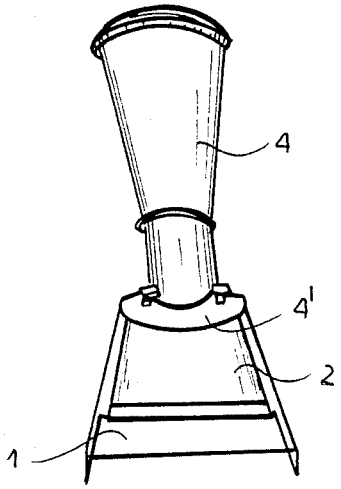
Figure 3:
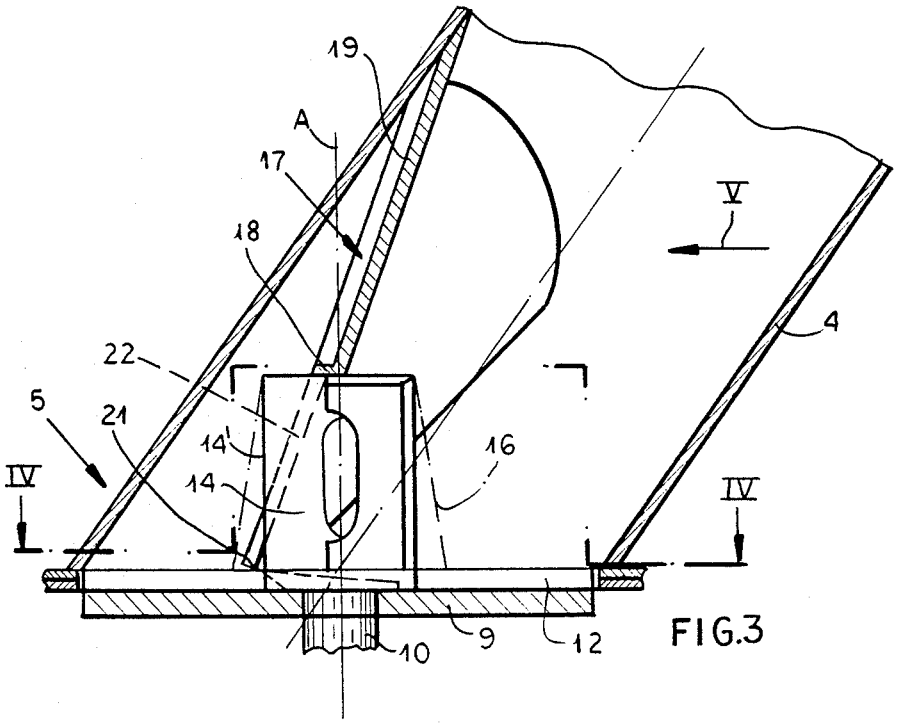
FIG. 3 is a vertical section through the intake hopper and blade assembly of the apparatus.
Figure 4:
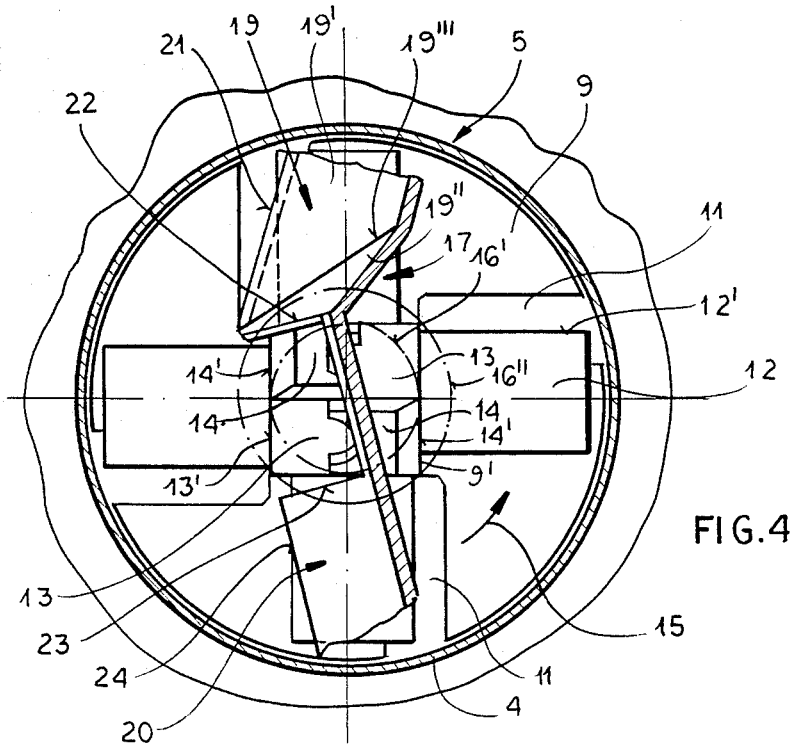
FIG. 4 is a section taken along line IV—IV of FIG. 3.
Figure 5:
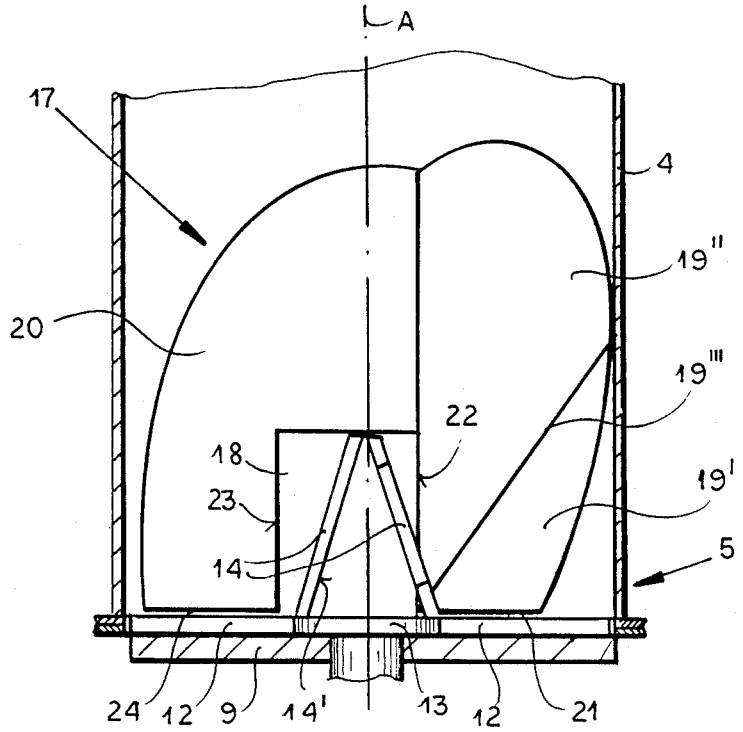
FIG. 5 is another vertical section of the structure of FIG. 3 but taken in the direction of arrow V of FIG. 3.

As seen in FIGS. 1 and 2 a chipper/shredder according to the invention basically comprises a housing 2 containing an electric or internal-combustion drive motor and forming a forwardly and downwardly directed chip outlet 1. This housing 2 is provided with wheels 3 so it can be moved about easily and has an intake chute or hopper 4 which is made of a durable synthetic resin and extends up and backward at an acute angle from a mainly horizontal base plate 4' made of metal. Inside the lower end of the chute 4 is a blade assembly 5 seen in FIGS. 3 through 7 in detail.

FIGS. 8 through 11 show how the base plate 4' is pivotal about an axis 6 on the housing 2 which to this end has T-shaped ears 2' that engage under tabs 4' of the plate 4'. In addition the plate 2' is provided with downwardly directed tabs 7, two in parallel planes perpendicular to the axis 6 and one parallel thereto, that engage in generally complementary slots 8 in the housing 2 to that, when the plate 4' is fitting flat on the housing 2, the tabs 7 effectively lock it in place against twisting thereon. At the same time the hinge formed by the interfitting tabs 2' and 4'' allows the intake chute 4 and its plate 4' to be pivoted up from the housing 2 and removed therefrom both to clear any jam and to allow the device to be stored compactly.

The blade assembly 5 basically comprises a circular lower blade plate 9 mounted horizontally at the top of a vertical drive shaft 10 constituting the output of the drive contained in the housing 2. According to this invention the blade plate 9 is rotated at about 250 rev/-min, substantially slower than the blade assemblies of prior-art chipper/shredders, in a direction 15 about the axis A of the drive shaft 10. This lower plate 9 is formed with four secantally extending and angularly equispaced rectangular apertures 11. A rectangular blade 12 is fixed to the plate 9 above each of the apertures 11 and has an edge 12'. In addition centrally fixed atop the lower plate 9 at the center thereof is a square upper blade plate 13 whose leading edges 13' (relative to a normal direction 15 of travel of the plates 9 and 13 about the axis A are virtually in line with the secantal cutting edges 12' of the blades 12 and also generally bisect the windows or apertures 11.

This plate 13 also carries two rectangular prechopping blades 14 which are mounted at opposite corners of the plate 13 and lean inward toward each other, symmetrically of the axis A so that the cutting edges 14' of these blades 14 extend upward from the opposite corners of the plate 13 in vertical planes parallel to the axis A from the plate edges 13'. Each of these blades 14 has a size equal to about half the size of the corresponding side of the plate 13. When rotated the blade edges 14' therefore describe a frustocone 16 defined between a small-diameter upper circle 16' and a large-diameter lower circle 16' both centered on the axis A.

The lower end of the intake hopper 4 is provided with an abutment/cutter plate 17 comprising an upstream portion 19 and a downstream portion 20 and forms a window or portal 18 over the blades 14. The upstream portion 19 is formed of two planar panels 19' and 19' joined at a bend 19'''. The panel 19' forms a less acute angle with the plane of the blade plate 9 than the portion 19'' and is formed on its lower edge with a cutting edge 21 that coacts with the blades 12. The panel 19'' has an edge 22 defining one side of the portal window 18 and constituting a cutting edge coacting with the blades 14, that is extending parallel to the frustoconical orbit 16 thereof. Similarly the portion 20 has an edge 23 defining the other side of the portal 18 and constituting a cutting edge coacting with the blades 14 and a lower edge 24 forming a cutting edge that coacts with the blades 12.

Figure 6:
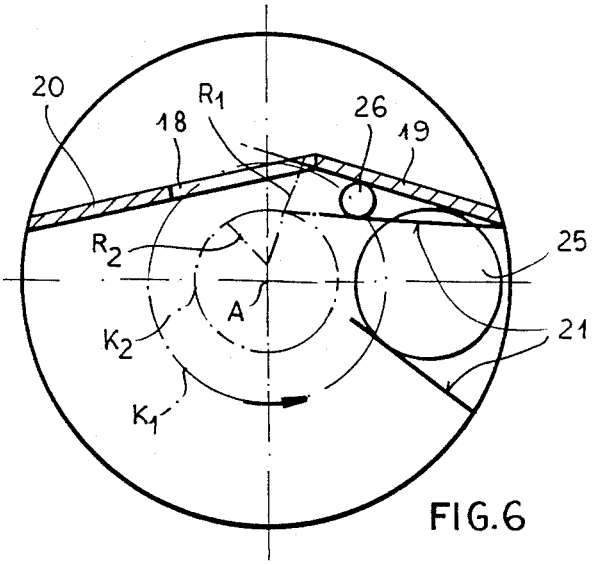
FIG. 6 is a top view of the blade plate with the abutment wall in section.
Figure 7:
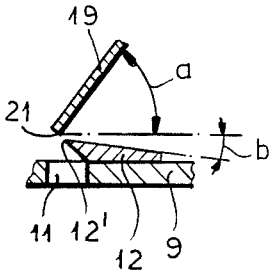
FIG. 7 is a vertical sectional view of a detail of the blade plate and abutment.
Figure 9:
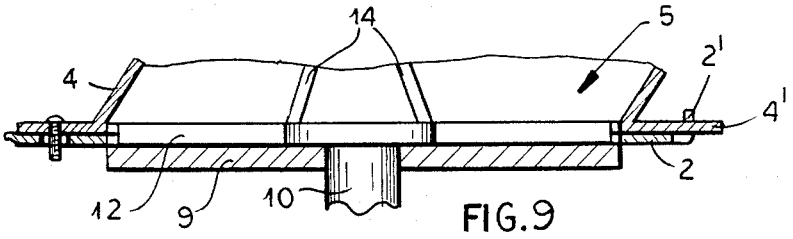
FIGS. 9, 10, and 11 are sections taken respectively along lines IX—IX, X—X, and XI—XI of FIG. 8.
Figure 8:
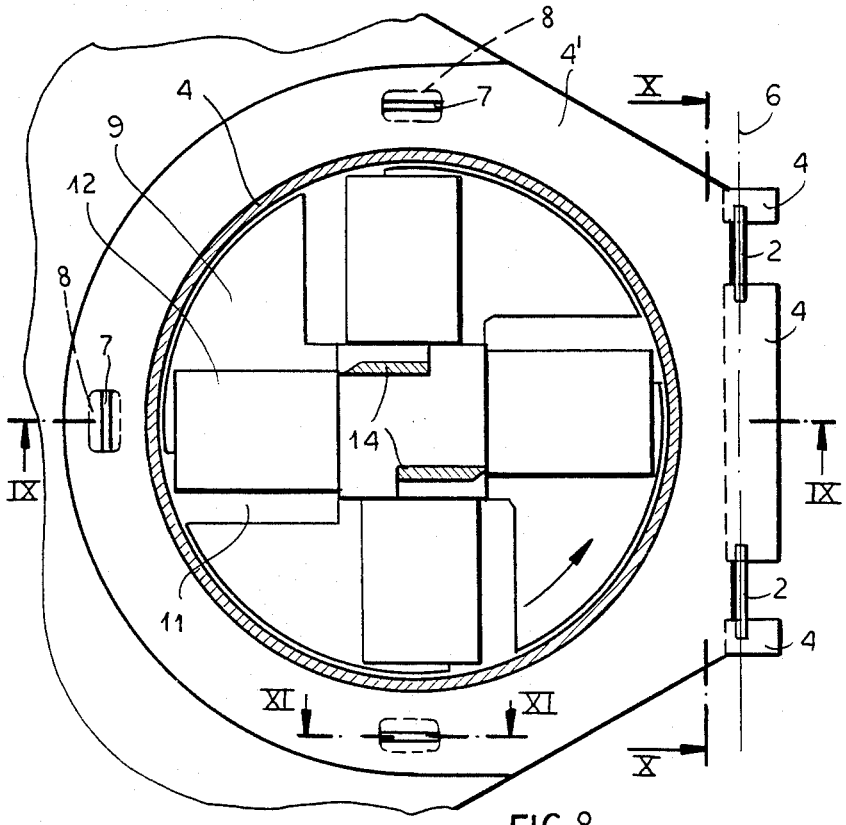
FIG. 8 is a partly sectional top view of the blade plate and the lower end of the intake hopper.
Figure 10:
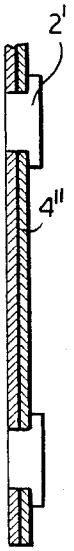
Figure 11:
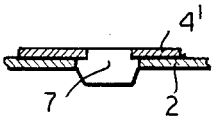

As shown in particular in FIGS. 6 and 7 the lower counter blade 21 of the upstream panel 19 is set at a tangent to a circle $K_1$ which has a larger radius $R_1$ than a circle $K_2$ which has a larger radius $R_2$ and which is the circle defined by the inner ends of the cutting edges 12' as they rotate about the axis A. As a result thicker branches 25 are cut further out from the axis into thin slices whereas thinner branches and twigs 26 are cut further in where they can be fed to the prechopping blades 14 for effective precomminution. There is thus an automatic separation of the material to be chopped into more and less easily chopped fractions.

To this end as illustrated in FIG. 7 the edge 21 of the first panel forms a relatively sharp angle a with a plane parallel to the plate 9 and to the plane of the orbit of the blade edges 12' while the top surfaces of these blades 12 form an acute angle b backward from this plane. The result is on the one hand an automatic self-feeding of the system while jamming is effectively ruled out.

It is also important for this precomminution effect that the frustoconical orbit of the blade edges 14' of the prechopping blades is oriented relative to the cutting edges 22 and 23 such that a downward pull is exerted on the material being cut. As a result the light material is surely drawn in and prechopped. In fact this light material is chopped first against the edge 22, then against the edge 23 and even to the edge 24 before it gets to the blades 12.

It would be possible according to this invention to operate without the second panel 20 and the edges 23 and 24, while still achieving relative quiet operation. Use of the full number of cutting edges is however useful to allow the machine operate at the lowest possible speed and with, therefore, the least possible noise.

I claim:

1. A garden chopping/shredding apparatus comprising:

a frame;

an upwardly open intake hopper on the frame having a lower end;

a generally horizontal blade plate in the lower end rotatable about an upright axis and formed about the axis with a plurality of angularly spaced apertures;

respective flat blades carried on the blade plate and having cutting edges above the apertures;

a plurality of prechopping blades carried on the blade plate and projecting upward therefrom, the prechopping blades having cutting edges inclined upward and inward toward the axis;

drive means for rotating the plate and the blades in a predetermined direction about the axis, for defining with the cutting edges of the flat blades a generally planar and circular orbit perpendicular to the axis and having an inner periphery offset radially outward from the axis, and for defining with the cutting edges of the prechopping blades an upwardly tapered frustoconical orbit centered on the axis and having a small-diameter upper end and a large-diameter lower end; and a deflector plate fixed against rotation in the lower end of the hopper and having a panel with a lower cutting edge juxtaposed with the orbit of the flat blades and an inner edge juxtaposed with the orbit of the prechopping blades, the panel forming an acute angle open backward into the direction of rotation with the orbit of the flat blades, the panel's lower cutting edge extending generally tangentially to a circle centered on the axis and having a greater diameter than the inner periphery of the orbit of the flat blades.

2. The chopping/shredding apparatus defined in claim 1 wherein the deflector plate has an upstream panel defining the lower and inner cutting edges and a downstream panel forming a portal opening over the prechopping blades with the upstream panel and having its own inner and lower cutting edges respectively juxtaposed with the orbits of the prechopping and flat blades also.

3. The chopping/shredding apparatus defined in claim 2 wherein the two panels extend at an obtuse angle to each other, the obtuse angle being open toward the axis and the upstream panel has an upstream portion and a downstream portion, the former forming a smaller angle with the flat-blade orbit than the latter and both forming the respective lower cutting edge.

4. The chopping/shredding apparatus defined in claim 2 wherein the blade plate has a substantially square upper plate carrying the prechopping blades and having diagonally opposite corners at the cutting edges of the prechopping blades.

5. The chopping/shredding apparatus defined in claim 4 wherein each prechopping blade extends over about half of a respective side edge of the upper plate and there are two prechopping blades symmetrically oppositely arranged on the upper plate with respect to the axis.

6. The chopping/shredding apparatus defined in claim 5 wherein there are four such flat blades and apertures angularly equispaced about the axis with each flat-blade cutting edge extending generally in line with a respective side edge of the upper plate.

7. The chopping/shredding apparatus defined in claim 6 wherein the flat blades are inclined back and down from the respective cutting edges.

8. The chopping/shredding apparatus defined in claim 1 wherein the drive means rotates the blades at less than about 300 rev/min.

9. The chopping/shredding apparatus defined in claim 1, further comprising a hinge supporting the hopper on the frame for movement between a use position sitting over the blade plate and a position with its lower end swung back away from the blade plate.

10. The chopping/shredding apparatus defined in claim 9 wherein the frame is provided with two tabs constituting part of the hinge and the hopper has a base plate provided with recesses receiving the tabs.

11. The chopping/shredding apparatus defined in claim 10 wherein the base plate is provided with a plurality of angularly offset centering tabs and the frame is provided with respective seats in which the centering tabs engage in the use position.

12. The chopping/shredding apparatus defined in claim 11 wherein the tabs are elongated and the seats are complementarily elongated.

* * * * *